US005700340A

United States Patent [19]

Johnson et al.

[11] Patent Number: 5,700,340

[45] Date of Patent: Dec. 23, 1997

[54] METHOD OF MANUFACTURING A TAPE HAVING A SUCCESSION OF SURFACE-TYPE FASTENER PIECES

[75] Inventors: David Johnson, St. Helens; James Ashman, Runcorn, both of England

[73] Assignee: YKK Corporation, Tokyo, Japan

[21] Appl. No.: 326,364

[22] Filed: Oct. 20, 1994

[30] Foreign Application Priority Data

Oct. 22, 1993 [GB] United Kingdom ..... 9321858

[51] Int. Cl.[6] ..... B32B 31/00

[52] U.S. Cl. ..... 156/152; 156/247; 156/261; 156/265; 156/267; 156/269; 156/289; 156/520

[58] Field of Search ..... 156/261, 267, 156/268, 269, 270, 289, 518, 519, 520, 247, 264, 265, 344, 584, 152, 248

[56] References Cited

U.S. PATENT DOCUMENTS

| | | | |
|---|---|---|---|
| 1,995,076 | 3/1935 | Perryman | 156/261 X |
| 1,995,077 | 3/1935 | Perryman | 156/261 |
| 2,033,553 | 3/1936 | Scholl | 156/518 X |
| 2,220,071 | 11/1940 | Avery | 156/261 |
| 3,551,245 | 12/1970 | Gamberini | 156/265 X |
| 3,574,026 | 4/1971 | Kucheck | 156/248 X |
| 4,069,077 | 1/1978 | Baumgartner | 156/265 X |
| 4,732,631 | 3/1988 | Shimizu | 156/73.3 |
| 4,863,551 | 9/1989 | Ogura | 156/261 X |
| 5,174,842 | 12/1992 | Hamuro et al. | 156/265 X |

FOREIGN PATENT DOCUMENTS 0210536 2/1987 European Pat. Off. .

*Primary Examiner*—James Sells
*Attorney, Agent, or Firm*—Hill, Steadman & Simpson

[57] ABSTRACT

A method of manufacturing a continuous elongated tape having a succession of surface type fastener pieces attached thereto, comprises the steps of: intermittently feeding a surface-type fastener tape blank composed of a release sheet and a surface-type fastener tape attached by an adhesive layer to the release sheet and comprising a base strip and a multiplicity of fastening elements on its upper surface; separating the surface-type fastener tape blank into an elongated surface-type fastener tape having the adhesive layer applied thereto on its lower side and the release sheet and feeding them in separated relation to each other; cutting the elongated surface-type fastener tape, thus forming a multiplicity of surface-type fastener pieces each having an adhesive layer attached thereto on its lower side; and pressing the thus-formed surface-type fastener pieces against the release sheet so that the surface-type fastener pieces are attached to the elongated release sheet longitudinally at intervals.

8 Claims, 3 Drawing Sheets

METHOD OF MANUFACTURING A TAPE HAVING A SUCCESSION OF SURFACE-TYPE FASTENER PIECES

BACKGROUND OF THE INVENTION

1. Field of the Invention

The present invention relates to a method of manufacturing a continuous elongated tape having a succession of surface-type fastener pieces of any desired contour adhered at regular intervals longitudinally to an elongated release sheet by an interposing adhesive layer. The surface-type fastener pieces each comprise a multiplicity of fastener elements such as hooks, loops or the like and can be easily peeled off the release sheet for use on a cover of a pocket of a garment, a bag, a brief case, or the like, or for use as a fastener on a diaper cover, a blood-pressure cuff, or the like.

2. Description of the Prior Art

The above-mentioned continuous elongated tape having a succession of surface-type fastener pieces adhered at regular intervals longitudinally to an elongated release sheet is very easy to peel the fastener pieces one by one off the release sheet. Furthermore, since such elongated tape can be stored and used in the form of being wrapped around a bobbin or spool, it has the edge over individual surface-type fastener pieces adhered to their respective release sheets in terms of inventory and storing. A method of manufacturing such a continuous elongated tape is well-known as disclosed in EP-A-0210536. According to the disclosed method, a continuous elongated surface-type fastener tape blank comprising an elongated release sheet and an elongated surface-type fastener tape attached to the release sheet over the entire width by an adhesive layer is intermittently fed to a fusion-cutting device composed of an ultrasonic horn and an anvil, with the blank remaining unseparated into the release sheet and the adhesive-layered fastener tape. Then, the elongated fastener tape remaining attached to the release sheet is severed by the fusion-cutting device in such desired patterns as to provide a multiplicity of surface-type fastener pieces of the desired pattern at a subsequent step. Subsequently, the elongated fastener tape having the multiplicity of surface-type fastener pieces attached to the release sheet is withdrawn from the fusion-cutting device. Lastly, the elongated surface-type fastener tape is peeled off the release sheet as a scrap tape, leaving the multiplicity of the surface-type fastener pieces attached at regular intervals longitudinally to the release sheet.

With such method coming to light, a tape manufacturer can conveniently store and supply an elongated surface-type fastener tape blank to customers who themselves sever the blank into surface-type fastener pieces of any desired contour by using this method. This advantageously enables the tape manufacturer to dispense with storing elongated release tapes having multiplicities of surface-type fastener pieces of various contours in high volume. This method is therefore quite advantageous inventory-wise.

However, this conventional method suffers drawbacks.

It is extremely difficult if not impossible to adjust the lowermost position which the ultrasonic horn assumes for effecting fusion-cutting, which is a decisive factor for producing the surface-type fastener pieces of desired contours without cutting the release sheet. Besides, each of the continuous layers of the elongated surface-type fastener tape blank; that is, the release sheet layer, the adhesive layer and the elongated surface-type fastener layer can vary in thickness from one batch to another. This renders the above-mentioned adjustment still more difficult and requires very high dexterity. Therefore, sometimes, the horn may not descend so low as it should do for the purpose. As a result, the ultrasonic horn fails to cut the elongated fastener tape throughout the entire thickness, thus leaving surface-type tape material between the fastener pieces and that portion of the fastener tape which will become the scrap tape, which precludes separation of the surface-type fastener pieces and the release sheet.

Conversely, sometimes, the ultra-sonic horn may descend lower than it needs to. As a result, the ultrasonic horn cuts not only the surface-type fastener tape blank but also the release sheet, thus failing to producing a complete elongated tape having a succession of surface-type fastener pieces desired contour attached longitudinally to a release sheet.

Although description has been so far made about the fusion-cutting of the elongated surface-type fastener tape blank by the ultrasonic horn and the anvil as disclosed in EP-A-0210536, mechanical cutting of the tape blank by a cutting punch and a die suffers from the same disadvantages. Considerable dexterity is also required for cutting the tape blank into a multiplicity of surface-type fastener pieces without cutting a release sheet.

SUMMARY OF THE INVENTION

With the foregoing difficulties in view, it is therefore an object of the present invention to provide a method of manufacturing a continuous elongated tape having a succession of surface-type fastener pieces of any desired contour adhered at regular intervals longitudinally to an elongated release sheet by an interposing adhesive layer, easily and reliably without severing the release sheet.

According to the present invention, there is provided a method of manufacturing a continuous elongated tape having a succession of surface type fastener pieces of a desired contour adhered thereto from a continuous elongated surface-type fastener tape blank comprising an elongated release sheet and an elongated surface-type fastener tape adhered to the release sheet by an adhesive layer, the elongated surface-type fastener tape having a multiplicity of fastening elements provided on one surface; the method comprising the steps of:

(a) intermittently feeding the continuous elongated surface-type fastener tape blank along a feed path to a cutting station;

(b) progressively separating the continuous elongated surface-type fastener tape blank into the elongated surface-type fastener tape having the adhesive layer on one surface thereof and the release sheet immediately before the cutting station;

(c) progressively severing the elongated surface-type fastener tape having the adhesive layer on said one surface into a multiplicity of surface-type fastener pieces of desired contour having an adhesive layer on one surface thereof at the cutting station, while intermittently feeding the elongated surface-type fastener tape through the cutting station; and (d) progressively applying the thus provided multiplicity of surface-type fastener pieces of desired contour to the release sheet by the adhesive layers, while intermittently feeding the elongated release sheet.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 4:
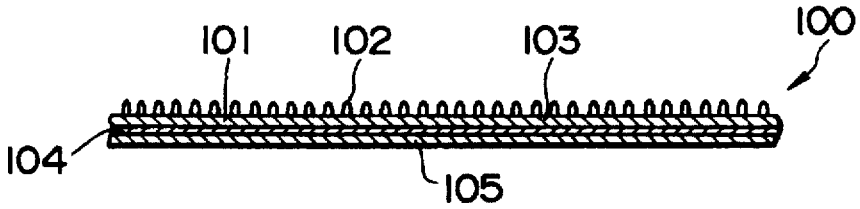
FIG. 4 is a fragmentary longitudinal cross-sectional view of a continuous elongated surface-type fastener tape blank which is subject to the method according to the present invention.

Before getting down to description of a method according to the present invention itself, a continuous elongated surface-type fastener tape blank 100 to which the present invention applies to will be described below first. As shown in FIG. 4, the continuous elongated surface-type fastener tape blank 100 broadly comprises an elongated fastener tape 103 including a base strip 101 and a multiplicity of fastening elements 102 such as hook fastening elements, loop fastening elements, or mixed hook/loop fastening elements provided on one surface thereof; a pressure-sensitive adhesive layer 104 applied to the other surface of the base strip 101; and an elongated release sheet 105 made of paper, non-woven fabric, a synthetic resinous sheet and the like applied to the other surface of the adhesive layer 104. The multiplicity of fastening elements 102 may be either hook fastening elements, loop fastening elements or mixed hook/loop fastener elements. The elongated surface-type fastener tape 103 may be either woven or knitted from synthetic resin yarns. Alternatively, the elongated surface-type fastener tape 103 may be made by injection-molding or extrusion-molding it from synthetic resin in such a way that the base strip 101 and the fastening elements 102 are formed integrally with each other. This continuous elongated surface-type fastener tape blank 100 is stored in a warehouse. And it is supplied to a factory for putting into practice the method according to the present invention as customers require.

Figure 1:
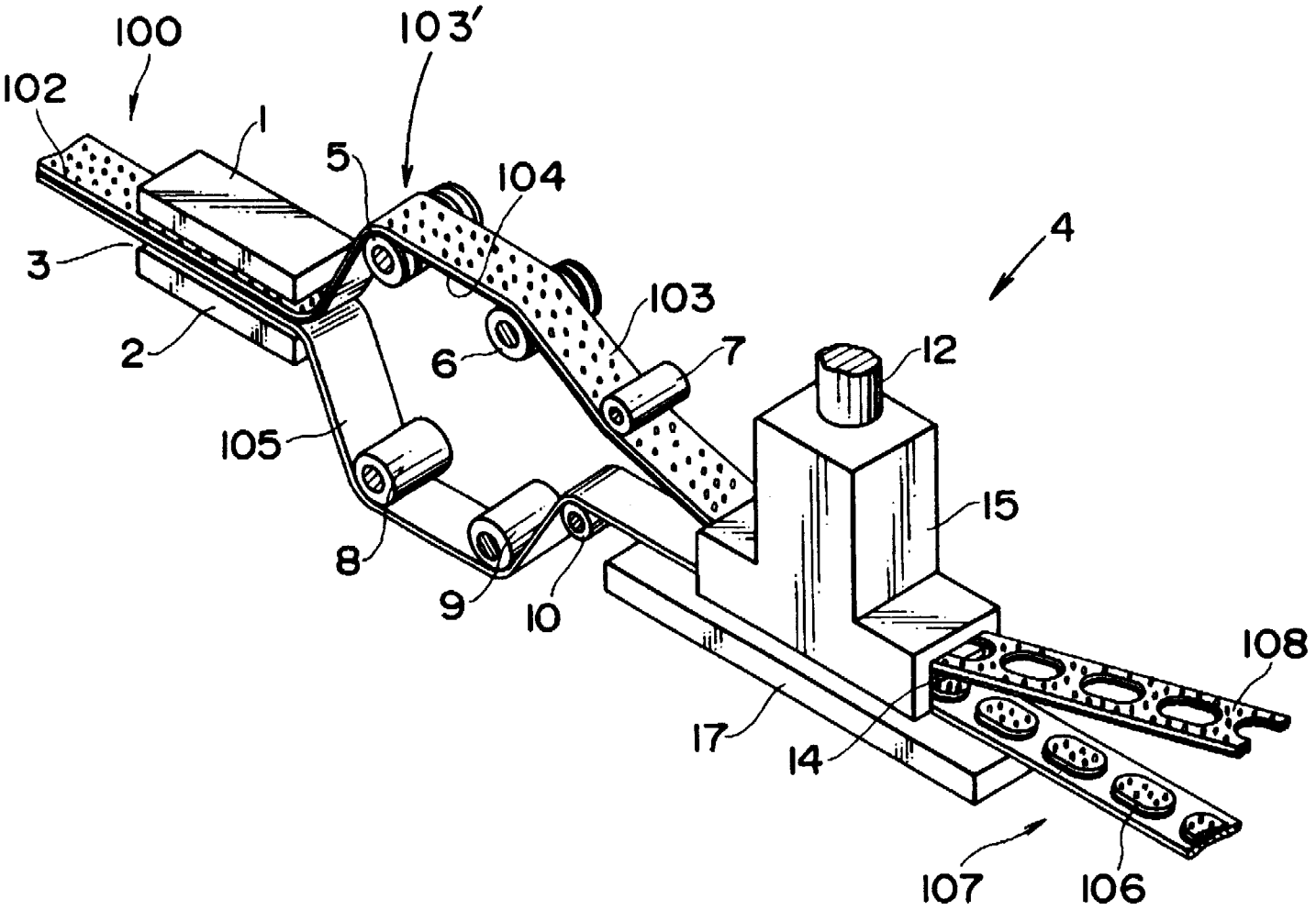
FIG. 1 is a schematic perspective view of an apparatus in which a method according to the present invention is put into practice.

As shown in FIG. 1, according to this embodiment, the continuous elongated surface-type fastener tape blank 100 is intermittently fed, with the fastening elements 102 facing up along a horizontal feed path 3 between a pair of upper and lower guide plates 1, 2 toward a cutting station 4. Immediately before fed into the cutting station 4, the continuous elongated surface tape 100 running along the feed path 3 is progressively separated by a set of guide rollers 5, 6, 7, 8, 9 and 10 into an elongated surface-type fastener tape 103 having the interlocking fastener elements 102 on the upper side facing up and having the adhesive layer 104 attached to the lower surface thereof (hereinafter called adhesive-layered fastener tape 103' for brevity) and the release sheet 105 as better shown in FIG. 1. Then, the adhesive layered fastener tape 103' and the release sheet 105 are intermittently fed in synchronism with each other.

Out of the set of guide rollers 5, 6, 7, 8, 9 and 10, those guide rollers 5, 6 which are held in rolling contact with the pressure-sensitive adhesive layer 104 of the elongated fastener tape 103 each have a plurality of parallel knurls or ridges 11 formed on its peripheral surfaces and separated axially thereof or perpendicularly of the feed path 3. This is intended for minimizing an area over which each of the guide rollers 5, 6 contacts the pressure-sensitive adhesive layer 104, thus preventing the guide rollers 5, 6 from sticking to the adhesive layer 104. Alternatively, each of the guide rollers 5, 6 may be provided on the peripheral surfaces with a fluorine-contained polymer layer which is unsusceptible to viscosity of the pressure-sensitive adhesive layer 104.

Figure 2:
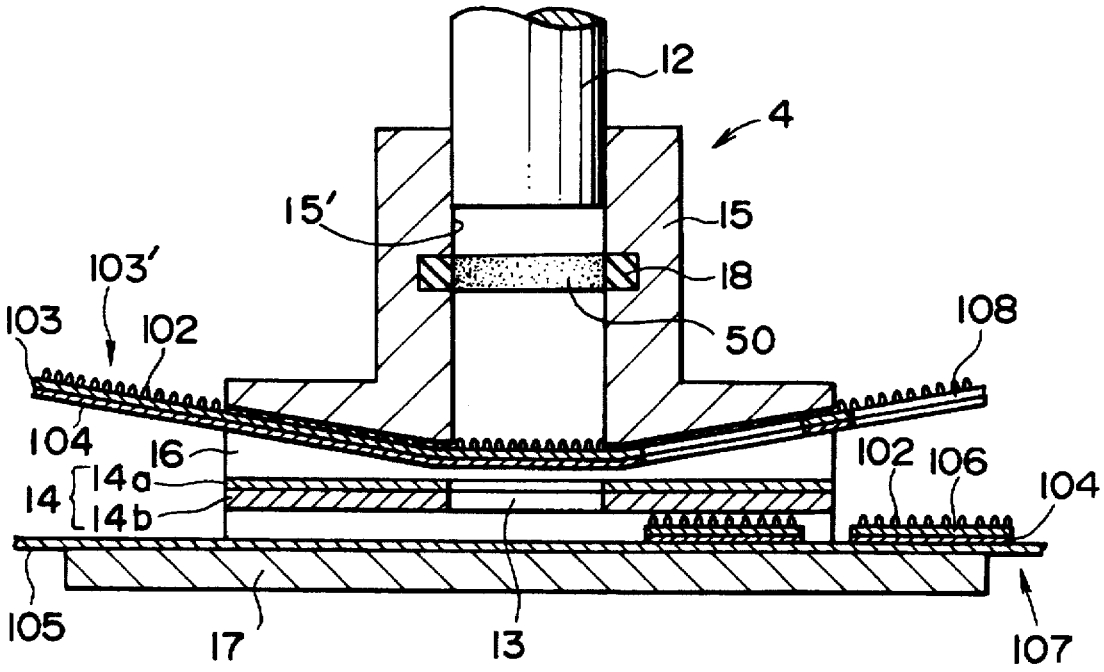
FIG. 2 is a schematic longitudinal cross-sectional view of a cutting station of the apparatus of FIG. 1, showing the cutting station disposed before a cutting step is taken.

The cutting station 4 is designed for severing the adhesive-layered fastener tape 103' into a multiplicity of surface-type fastener pieces 106 each having an adhesive layer 104 and so contoured as customers desire. As better shown in FIG. 2, the cutting station 4 generally comprises a cutting punch 12 vertically reciprocal for severing the adhesive-layered fastener tape 103' into the fastener pieces 106 of desired contour and a die 14 having a die hole 13 formed therethrough through which the lowermost part of the cutting punch 12 passes during the vertical reciprocation of the cutting punch 12. Reference numeral 15 denotes a punch guide block, which has a through punch hole 15' formed centrally therethrough. The cutting punch 12 reciprocally move through the through hole 15' of the punch guide lock 15 for the above-mentioned purpose. The central through hole 15' of the punch guide block 15 is disposed in registry with the die hole 13 of the die 14. The lower side of the punch guide block 15 and the upper side of the die 14 define therebetween a feed passage 16 through which the adhesive-layered fastener tape 103' is fed substantially horizontally. The minimum distance between the lower side of the punch guide block 15 and the upper side of the die 14 is set to be slightly greater than the thickness of the adhesive-layered fastener tape 103'. And, the adhesive-layered fastener tape 103' is held taut with the surface having the fastening elements 102 in intimate contact with the lower surface of the punch guide block 15. With these factors combined, normally, the adhesive layer 104 underlying the elongated fastener tape 103 will not touch the upper side of the die 14. As shown in FIG. 2, the lower surface of the punch guide block 15 is slanted up outwardly from the lower edge of the central hole 15' toward the opposed ends, as closely described hereinafter. With the construction set forth above, the adhesive-layered fastener tape 103' is fed along the feed passage 16 smoothly or without any difficulties at the cutting station 4.

A guide plate 17 is laid under the die 14 of the cutting station 4 for guiding the elongated release sheet 105 horizontally therealong. The distance between the lower side of the die 14 and the upper side of the guide plate 17 is set to be slightly greater than the combined thicknesses of the release sheet 105 and the surface-type fastener piece 106 having the adhesive layer 104 attached to the lower side thereof which will be punched and adhered to the release sheet 105 by the reciprocation of the cutting punch 12.

With the construction of the cutting station 4 stated hereinabove, after separated by the set of guide rollers 5, 6, 7, 8, 9 and 10, the adhesive-layered fastener tape 103' is intermittently fed along the feed passage 16 while the elongated release sheet 105 is intermittently fed between the die 14 and the guide plate 17. This means that the adhesive-layered surface-type fastener tape 103' and the release sheet 105, while fed intermittently, are held in suitably separated relation to each other with the die 14 interposed therebetween. As a result, the adhesive-layered surface-type fastener tape 103' and the release sheet 105 can be fed at the same rate, in synchronism, smoothly and without interfering with each other through the cutting station 4.

Figure 3:
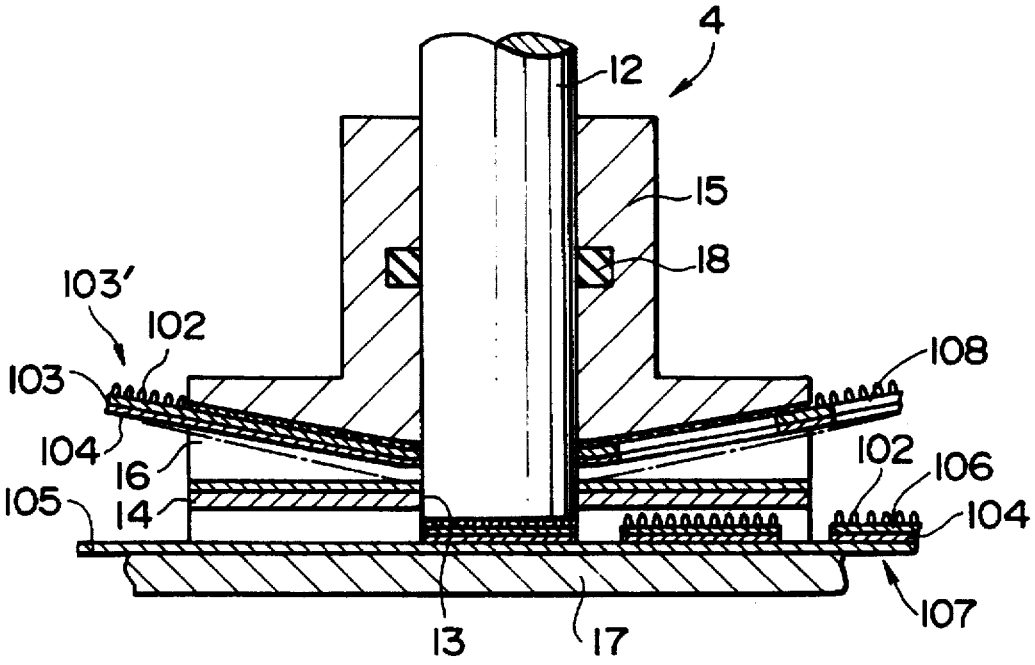
FIG. 3 is a view similar to FIG. 2 but showing the cutting station disposed while the cutting step is being taken.
Figure 5:
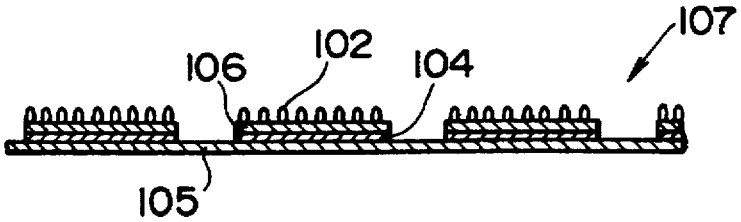
FIG. 5 is a fragmentary longitudinal cross-sectional view of a continuous elongated tape having a succession of surface-type fastener pieces of any desired contour adhered at regular intervals longitudinally to an elongated release sheet by an interposed adhesive layer.

Each time that the adhesive-layered fastener tape 103' and the release sheet 105 stop at the cutting station 4, as shown in FIG. 3, the cutting punch 12 is actuated by a suitable drive means such as a fluid drive (not shown) to descend toward the die 14, to thus sever the adhesive-layered fastener tape 103' to provide a surface-fastener piece 106 having an adhesive layer 104 on its lower surface. Continued descent of the cutting punch 12 through the die hole 13 of the die 14 causes the thus provided surface-fastener piece 106 having the adhesive layer 104 on the lower side pressed against the upper surface of the release sheet 105 so that the surface-type fastener piece 106 is adhered to the release sheet 105 by the interposed adhesive layer 104. As this cycle is repeated, the cutting station 4 produces a continuous elongated tape 107 comprising the elongated release sheet 105 and a succession of surface-type fastener piece 106 of a desired contour attached to the upper surface of the release sheet 105 by the adhesive layer 104, as shown in FIG. 5. And, as shown in FIG. 3, the continuous elongated tape 107 is fed between the die 14 and the guide plate 17 downstream of the cutting station 4.

As shown in phantom lines in FIG. 3, as lowered by the cutting punch 12, the adhesive-layered fastener tape 103' is forced down and against the upper surface of the die 14 around the die hole 13 so that the adhesive layer 104 tentatively sticks to the upper surface of the die 14. However, since held taut in the direction of feeding; the adhesive-layered fastener tape 103' is forced to detach from the upper surface of the die 14 under the tension as soon as the cutting punch 12 starts to ascend to thus ensure that the feed passage 16 is fully cleared after each stroke of the cutting punch 12. It is to be noted here that the feed passage 16 diverges from the center toward the opposed ends, as mentioned earlier. This advantageously causes the adhesive-layered fastener tape 103' less liable to sticking to the die 14 when the cutting punch 12 descend through the die hole 13 of the die 14.

After punched by the cutting punch 12, the adhesive-layered fastener tape 103' has turned to an elongated scrap tape 108 which has a succession of holes punched at regular intervals longitudinally thereof by the cutting punch 12, as better shown in FIG. 1.

According to the embodiment set forth above, mere reciprocation of the cutting punch 12 in repeated cycles can cause the adhesive-layered fastener tape 103' severed into a succession of a surface-type fastener pieces 106 having an adhesive layer 104 attached to the lower side, and subsequently cause the thus provided fastener pieces 106 adhered to the elongated release sheet 105. As a result, there is provided the release sheet 105 having only the multiplicity of the surface-type fastener pieces 106 attached thereto. Advantageously, a simple and compact apparatus will do to put this method into practice, as compared with the conventional method. According to the conventional method, immediately after undergoing the cutting step, the release sheet has the scrap tape attached thereto, in addition to the surface-type fastener pieces. Therefore, the conventional apparatus is more complicated in that it must have an additional means for peeling the scrap tape from the release sheet.

As set forth hereinabove, the method according to the present invention is very simple and can provide the continuous elongated tape 107 comprising the elongated release sheet 105 having the succession of surface-type fastener pieces 106 attached at regular intervals longitudinally thereto, without any risk of erroneously cutting the release sheet.

The contour of the surface-type fastener piece 106 may vary by changing the shapes of the cutting punch 12 and the die 14. Furthermore, the cutting punch 12 and the die 14 may be replaced with an ultrasonic horn and an anvil for fusion cutting.

Reference numeral 18 in FIG. 2 and 3 denotes a felt made of any suitable fibers and infiltrated with cleaning oil. The felt 18 is embedded in a peripheral groove 50 formed in an inner periphery of the punch hole 15' for wiping out adhesive waste deposited on the tip of the cutting punch 12 when the cutting punch 12 ascend back to an uppermost position.

As shown in FIGS. 2 and 3, the die 14 comprises a pair of upper and lower layers **14*a* and 14*b*, of which the upper layer 14*a* may be replaced with a new one when the upper layer 14*a* wears at a peripheral edge around the die hole 13**.

The upper layer **14*a* of the die 14 may be coated at least on and around the die hole 13 with a fluorine-contained polymer for preventing the die 14 from sticking to the adhesive layer 104**.

Obviously, various modifications and variations of the present invention are possible in the light of the above teaching. It is therefore to be understood that within the scope of the appended claims the invention may be practiced otherwise than as specifically described.

What is claimed is:

1. A method of manufacturing a continuous elongated tape having a succession of surface type fastener pieces of a desired contour adhered thereto from a continuous elongated surface-type fastener tape blank comprising an elongated release sheet and an elongated surface-type fastener tape adhered to the release sheet by an adhesive layer, the elongated surface-type fastener tape having a multiplicity of fastening elements provided on one surface; the method comprising the steps of:

(a) intermittently feeding the continuous elongated surface-type fastener tape blank along a feed path to a cutting station;

(b) progressively separating the continuous elongated surface-type fastener tape blank into the elongated surface-type fastener tape having the adhesive layer on one surface thereof and the release sheet immediately before the cutting station;

(c) repeatedly severing the elongated surface-type fastener tape having the adhesive layer on said one surface into a multiplicity of surface-type fastener pieces of desired contour having an adhesive layer on one surface thereof at the cutting station, and simultaneously separating said surface type fastener pieces from a remaining scrap tape while intermittently feeding the elongated surface-type fastener tape through the cutting station; and (d) repeatedly applying the thus provided multiplicity of surface-type fastener pieces of desired contour to the release sheet by the adhesive layers, while intermittently feeding the elongated release sheet.

2. A method according to claim 1, the elongated surface-type fastener tape having the adhesive layer on said one surface and the elongated release sheet being held in suitably separated relation to each other at the cutting station; the elongated surface-type fastener tape having the adhesive layer on said one surface being progressively severed into the multiplicity of surface-type fastener pieces having the adhesive layer on said one surface thereof, and subsequently the surface-type fastener pieces being pressed against the release sheet so that the surface-type fastener pieces are progressively adhered to the release sheet by the adhesive layer.

3. A method a manufacturing a continuous elongated tape, comprising:

intermittently feeding a continuous elongated surface fastener tape laminate along a feed path to a cutting station, said laminate including an elongated surface-type fastener tape, an adhesive layer, and a release sheet, said adhesive layer between said surface-type fastener tape and said release sheet;

progressively separating the elongated surface-type fastener tape and adhesive layer from said release sheet upstream of said cutting station;

at said cutting station providing a reciprocating cutting-punch above said elongated surface-type fastener tape;

intermittently feeding said release sheet and said surface-type fastener tape with adhesive layer separated by a gap, through said cutting station; and reciprocating said cutter-punch to repeatedly sever and separate surface-type fastener pieces from said surface-type surface fastener tape and transporting said separated pieces across said gap to place said pieces onto said release sheet.

4. The method according to claim 3, comprising the further step of providing a dye within said gap at said cutting station, said dye having a dye hole shaped for the select contour of the surface-type fastener pieces.

5. A method of manufacturing a continuous elongated tape having a succession of surface-type fastener pieces of a desired contour adhered thereto, comprising:

intermittently feeding a continuous elongated surface-type fastener tape laminate along a feed path to a cutting station, the laminate including a surface-type fastener tape, and adhesive layer, and a release sheet;

progressively separating the continuous elongated surface-type fastener tape and adhesive layer together from said release sheet, immediately before the cutting station;

repeatedly severing the elongated surface-type fastener tape and adhesive layer into a multiplicity of surface-type fastener pieces while intermittently feeding the elongated surface-type fastener tape through the cutting station;

separating said fastener pieces from remaining scrap tape of the surface-type fastener tape at the cutting station; and repeatedly applying the thus separated multiplicity of surface-type fastener pieces to the release sheet while intermittently feeding the elongated release sheet.

6. The method according to claim 5, wherein said steps of severing, separating and applying are accomplished by a single stroke of a reciprocating cutter-punch.

7. The method according to claim 5, wherein said surface-type fastener tape and said release sheet are incrementally progressed through said cutting station, spaced apart by a gap, and said step of applying is further defined in that the separated surface-type fastener piece is transported across said gap to be placed on said release sheet.

8. The method according to claim 7, wherein said steps of severing, separating and applying are further defined in that a reciprocating punch is provided at said cutting station, one stroke of said reciprocating punch severing, separating and applying said surface-type fastener piece to said release sheet from said surface-type fastener tape.

* * * * *